US008439649B2

(12) United States Patent
Rutherford et al.

(10) Patent No.: US 8,439,649 B2
(45) Date of Patent: May 14, 2013

(54) SPUTTER ION PUMP WITH ENHANCED ANODE

(75) Inventors: Sherman Lloyd Rutherford, Portola Valley, CA (US); Jeffrey Richard Winkler, Livermore, CA (US)

(73) Assignee: Duniway Stockroom Corp., Mountain View, CA (US)

( * ) Notice: Subject to any disclaimer, the term of this patent is extended or adjusted under 35 U.S.C. 154(b) by 657 days.

(21) Appl. No.: 12/611,076

(22) Filed: Nov. 2, 2009

(65) Prior Publication Data

US 2011/0103975 A1 May 5, 2011

(51) Int. Cl.
*F04F 99/00* (2009.01)

(52) U.S. Cl.
USPC ..... 417/49; 417/48; 313/231.01; 313/359.1; 315/111.01

(58) Field of Classification Search ..... 417/48, 417/49; 313/231.01, 359.1; 315/111.01
See application file for complete search history.

(56) References Cited

U.S. PATENT DOCUMENTS

| | | | | |
|---|---|---|---|---|
| 2,993,638 | A | 7/1961 | Hall et al. | |
| 3,091,717 | A | 5/1963 | Rutherford et al. | |
| 3,231,175 | A * | 1/1966 | Zaphiropoulos | 417/49 |
| 3,319,875 | A | 5/1967 | Jepsen | |
| 4,097,195 | A * | 6/1978 | Hill | 417/49 |
| 4,146,497 | A * | 3/1979 | Barosi et al. | 252/181.6 |
| 4,334,829 | A * | 6/1982 | Harbaugh | 417/49 |
| 4,492,110 | A | 1/1985 | Bergquist | |
| 4,534,204 | A | 8/1985 | Bergquist | |
| 4,631,002 | A | 12/1986 | Pierini | |
| 4,969,556 | A | 11/1990 | Ishimaru et al. | |
| 5,150,001 | A | 9/1992 | Crewe | |
| 5,399,860 | A | 3/1995 | Miyoshi et al. | |
| 5,426,300 | A | 6/1995 | Voss et al. | |
| 5,448,612 | A | 9/1995 | Kasumi et al. | |
| 5,685,963 | A | 11/1997 | Lorimer et al. | |
| 5,879,134 | A | 3/1999 | Lorimer et al. | |
| 5,993,165 | A | 11/1999 | Lorimer et al. | |
| 6,004,104 | A | 12/1999 | Rutherford | |
| 6,165,328 | A | 12/2000 | Lorimer et al. | |
| 6,396,207 | B1 | 5/2002 | Hasegawa et al. | |
| 6,489,720 | B1 | 12/2002 | Gofuku et al. | |
| 6,491,560 | B1 | 12/2002 | Whalin | |

(Continued)

OTHER PUBLICATIONS

Audi, M., *An Introduction to Ion Pumps*, CERN Accelerator School, Varian Vacuum Technologies, May 2006, pp. 1-54, Palo Alto, CA.

(Continued)

*Primary Examiner* — Charles Freay
*Assistant Examiner* — Patrick Hamo
(74) *Attorney, Agent, or Firm* — Dorsey & Whitney LLP

(57) ABSTRACT

A sputter ion pump including an evacuateable envelope having a chamber, first and second cathodes and an anode disposed in the chamber. The anode can have an outer layer of a non-evaporable getter (NEG) material so as to permit NEG pumping of gases by the anode. In another aspect of the invention, the anode can be formed with spaced-apart first and second sheet portions disposed in juxtaposition to each other and having a plurality of holes extending through the sheets for forming a plurality of anode cells.

22 Claims, 2 Drawing Sheets

U.S. PATENT DOCUMENTS

| | | | |
|---|---|---|---|
| 6,518,637 | B1 | 2/2003 | Thompson et al. |
| 6,559,596 | B1 | 5/2003 | Arai et al. |
| 6,596,522 | B2 | 7/2003 | Tsien et al. |
| 6,652,343 | B2 | 11/2003 | Hasegawa et al. |
| 6,762,547 | B2 | 7/2004 | Arai et al. |
| 7,074,272 | B2 | 7/2006 | Thompson et al. |
| 7,279,846 | B2 | 10/2007 | Gofuku et al. |
| 7,301,269 | B2 | 11/2007 | Gofuku et al. |
| 7,446,467 | B2 | 11/2008 | Tsuda et al. |
| 7,511,425 | B2 | 3/2009 | Tsuda et al. |
| 7,519,158 | B2 | 4/2009 | Gadre et al. |
| 7,615,765 | B2 | 11/2009 | Katagiri et al. |
| 7,635,943 | B2 | 12/2009 | Kamio et al. |
| 7,670,849 | B2 | 3/2010 | Henkin |
| 7,759,652 | B2 | 7/2010 | Ohshima et al. |
| 7,781,743 | B2 | 8/2010 | Katagiri et al. |

OTHER PUBLICATIONS

Berger, Philip S., *Miniature Mass Spectrometer for Earth Science Research*, Phase I SBIR Contract No. S1.08-9921, Ceramitron, LLC, Jul. 22, 2009, pp. 1-25, Final Report, St. Louis, MO.

Ferris, Michael, *NEG Pumps, Magic in the Vacuum Chamber?*, SAES Getters USA, Inc., Vacuum Technology & Coating, Aug. 2002, pp. 52-59, www.vactechmag.com.

* cited by examiner

SPUTTER ION PUMP WITH ENHANCED ANODE

SCOPE OF THE INVENTION

The present invention relates to sputter ion pumps and more particularly to anode structures of sputter ion pumps.

BACKGROUND

In a sputter ion pump, gases are pumped by being ionized and accelerated to a cathode and then either becoming embedded in the cathode material of the pump, being buried by cathode material sputtered by bombardment of the accelerated ions, or by chemical combination with the sputtered cathode material. The crossed electric and magnetic fields of the Penning cell or cells in the chamber of a sputter ion pump are utilized to provide a plasma discharge in the anode structure of the cell. Positive ions are produced in the discharge from the gases to be evacuated, and are accelerated by the electric field and bombard or react with a cathode structure of the cell or to sputter off cathode particles. The sputtered particles condense on other surfaces of the cathode structure, the anode structure or other surfaces inside the pump, and entrap ions through the various entrapment mechanisms to reduce pressure within the pump. These entrapment mechanisms include chemical combination for chemically active gases such as oxygen and nitrogen; electrical neutralization, burial and diffusion for small gas molecules such as hydrogen and helium; and electrical neutralization, burial and covering over with further sputtered deposits. The covering mechanism, also known as a capturing mechanism, is particularly suited for pumping noble gasses such as argon, neon, krypton and xenon.

The structure and operation of sputter ion pumps is well known. See, for example, U.S. Pat. Nos. 2,993,638, 3,319,875, 3,091,717 and 4,631,002. The electrical configurations of sputter-ion pumps include the "diode" configuration, in which a positive high voltage is applied to the anode structure and the cathode structure is maintained at ground potential, and the "triode" configuration, in which a negative high voltage is applied to the cathode structure and the anode structure is maintained at ground potential.

Nonevaporable getter pumps, or NEG pumps, are also well known. NEG pumps typically consist of a flange, heater and cartridge, and work by chemical reaction and phase change to sorb gases on the NEG material of the cartridge. Nonevaporable getter pumps are particularly suited for pumping non-noble gases such as hydrogen, nitrogen and oxygen.

It is common to operate sputter ion pumps and NEG pumps in tandem, although NEG ion pumps have been provided in which the housing of the pump is internally coated with a getter thin film.

DESCRIPTION OF THE INVENTION

Figure 1:
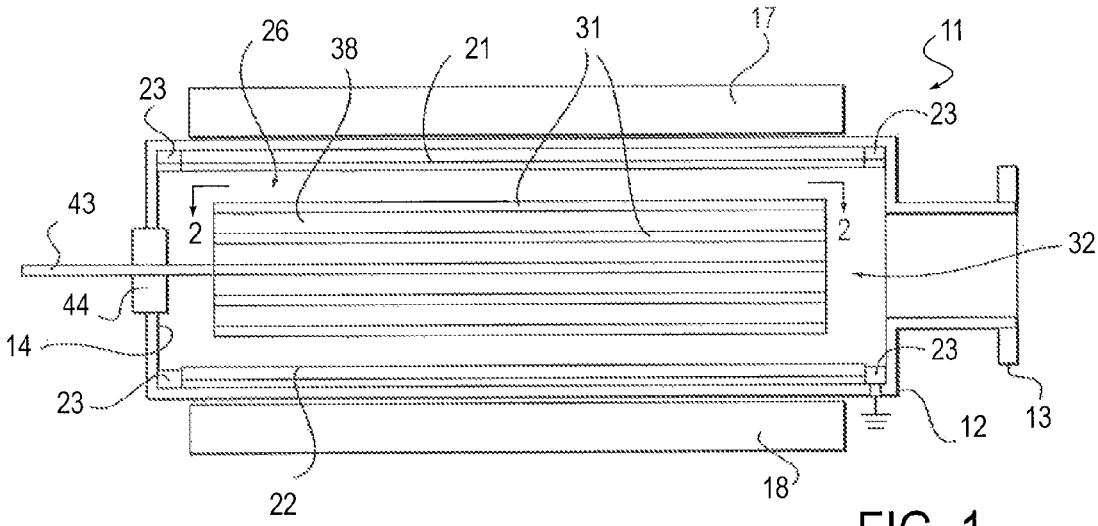
FIG. 1 is a schematic cross-sectional view of a sputter ion pump with an anode of the present invention.

A sputter ion pump 11 incorporating an anode structure in accordance with the present invention is schematically illustrated in FIG. 1. The pump 11 includes an evacuateable housing or envelope 12 adapted to be connected by means of a flange 13 to a system (not shown) to be evacuated. The envelope, made from any suitable material such as stainless steel or aluminum, is provided with an internal chamber 14 that fluidically communicates with the system to receive the system gases to be pumped. A pumping element such as a Penning cell or cells is included in the pump and has a first magnet 17 and a second magnet 18 disposed in spaced-apart positions, preferably outside of the envelope 12. A first cathode structure or cathode 21 and a second cathode structure or cathode 22 are disposed in spaced-apart positions inside the envelope 12, and spaced from the inside surface of the envelope 12 by means of respective conductive spacers 23. The first and second cathodes 21 and 22 are aligned between the respective first and second magnets 17 and 18, and can be of any suitable shape such as a planar rectangular sheet. Each of the cathodes 21 and 22 can be solid with smooth surfaces, slotted or otherwise patterned, and made from any suitable getter material such as titanium, tantalum, zirconium or a combination of these materials. In one embodiment, the first cathode 21 is made from titanium and the second cathode 22 is made from tantalum.

Figure 2:
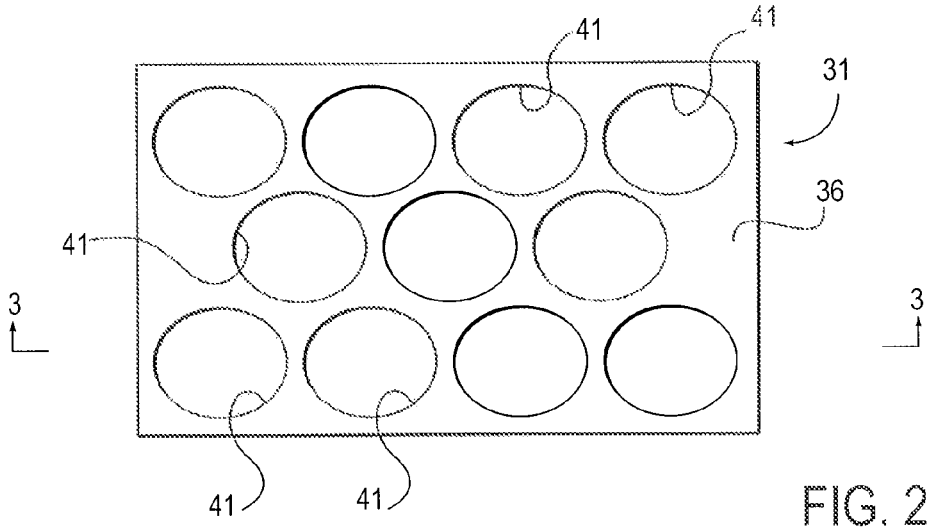
FIG. 2 is a top plan view of the anode of FIG. 1 taken along the line 2-2 of FIG. 1.
Figure 3:
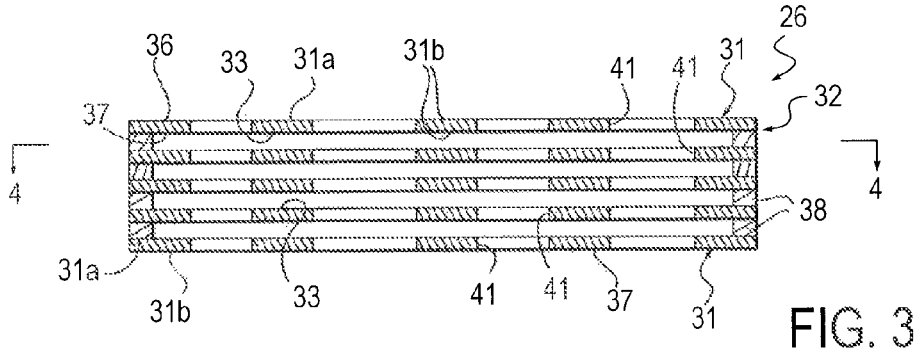
FIG. 3 is a cross-sectional view of the anode of FIG. 1 taken along the line 3-3 of FIG. 2.

An anode structure or anode 26 is included in the Penning cell pumping element and disposed in the envelope 12 spaced apart from but between the first and second cathodes 21 and 22 (see FIG. 1). The anode 26, which is preferably aligned between the first and second magnets 17 and 18 as well as the first and second cathodes 21 and 22, can be of any suitable type and in one embodiment includes a plurality of spaced-apart sheet portions or sheets 31 disposed in juxtaposition to each other to form a stack 32 (see FIGS. 1-3). Any number of sheets 31 can be provided and in one embodiment five sheets are provided. A gap or space 33 is thus provided between each set of adjacent sheets 31. The sheets 31 can be of any suitable size and shape, preferably approximating the shape of the cathodes 21 and 22, and can have a planar, rectangular shape similar to the rectangular shape of the cathodes 21 and 22. In one embodiment, each of the distinct sheets 31 is made from any suitable material such as stainless steel. In another embodiment, each sheet 31 has an inner portion or body 31*a* made from any suitable material such as a conductive metal and an outer portion 31*b* made from any suitable non-evaporable getter material such as an alloy of zirconium, vanadium, titanium, palladium or a combination of these reactive metals. The outer portion 31*b* can be in the form of a layer disposed on the body 31*a*. Each of the sheets 31 has opposite first and second planar surfaces 36 and 37, which can each be formed from the outer surface of layer 31*b*.

Figure 4:
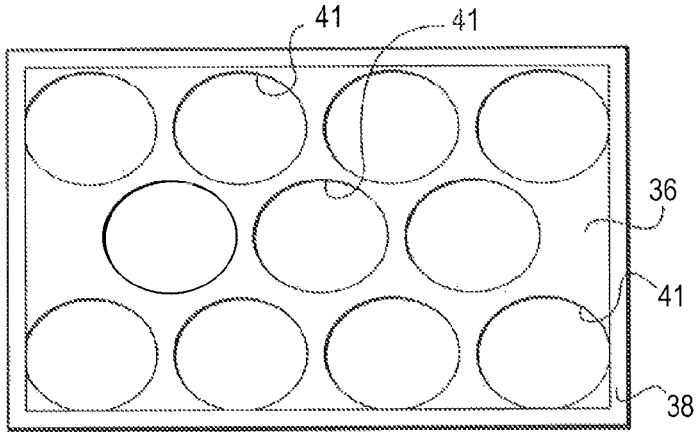
FIG. 4 is a cross-sectional view of the anode of FIG. 1 taken along the line 4-4 of FIG. 3.

At least one spacer 38 is disposed between each of the adjacent spaced-apart sheets 31 to form the gap 33 between adjacent sheets. The spacer can be made from any suitable material such as a conductive metal so that the stack 32 acts as a single electrical body. In one embodiment the at least one spacer can be a single rectangular strip extending between the periphery of the adjacent sheets 31 (see FIGS. 1, 3 and 4). In another embodiment, not shown, one or more of the spacers 38 can be formed from a plurality of strip portions or segments, for example spaced around the periphery of the adjacent sheets 31. The spaces between the strip portions or segments enhance the access of gases to the sheets 31 and thus increase pumping by the anode 26. In the embodiment where five sheets 31 are provided, four spacers 38 are preferably provided so that a sheet 31 forms the top and bottom of stack 32. The sheets 31 and spacers 38 of the stack can be secured together in any suitable manner such as by screws or clamps (not shown).

Each of the sheets 31 has a plurality of holes 41 extending between the first surface 36 and the second surface 37, preferably in an identical pattern so that respective holes 41 in the sheets 31 are aligned relative to each other. Each of the holes 41 can be of any suitable size and shape. Each set of aligned holes 41 in the sheets 31 forms a through hole or passageway extending through the stack 32 of the anode 26, and thus an anode cell, which is aligned substantially perpendicular to the first and second cathodes 21 and 22. The transverse dimension and length of each through hole can be chosen as a function of the magnitude of the magnetic field generated between the first and second magnets 17 and 18. In this regard, the diameter of the holes 41 can be chosen to provide good Penning cell operation in the available magnetic field. Typical values of anode cell diameter, that is the diameter of hole 41, times the magnetic field provided by magnets 17 and 18 to obtain good Penning cell discharge intensity can be between 0.5 and 2.0 kilogauss-inches. The anode cell aspect ratio, that is the length of the each through hole divided by the diameter of the through hole, can be between 0.5 and 2.0. The length of the through hole in this calculation is the distance between the outermost surfaces of the stack 32, that is the first surface 36 of the top sheet 31 and the second surface 37 of the bottom sheet 31 of the stack 32 (see FIG. 3).

In one exemplary embodiment, each sheet 31 is provided with a plurality of rows and columns of holes 41 so that the resulting anode 26 and Penning cell has a square packed configuration. In another exemplary embodiment, illustrated in FIGS. 2 and 4, the holes 41 can be in an offset arrangement or close packed configuration in which the holes of every other row are in relative longitudinal alignment and the holes in the row between such every other row are longitudinally offset relative to the holes of such every other row.

Anode 26 of the diode pump 11 is electrically coupled to a conductive rod 43 and supported within the envelope 12 by the rod 43 (see FIG. 1). The rod 43 extends through the envelope 12 and is supported and electrically isolated from the envelope by an insulating support 44. The first and second cathodes 21 and 22, as well as the envelope 12, are grounded.

In operation, a positive potential of between 3 kv and 7 kv is applied to the anode 26 by means of conductive rod 43, while the first and second cathodes 21 and 22 and envelope 12 are maintained at ground potential. A magnetic field is provided parallel to the axis of each through hole formed from the respective plurality of holes 41 provided in the stack 32 of sheets 31 forming the anode 26. The high voltage between the anode 26 and the cathodes produces an electrical breakdown of the gases within the envelope 12 to form a glow or gas discharge between each set of cathode elements 21 and holes 41. At least some of the gases are ionized in this process. The magnetic field formed by first and second magnets 17 and 18 causes the glow discharge to form a column within the set of holes. Positive ions produced in the glow discharge from the gases strike the cathodes 21 and 22. Such ionized molecules are neutralized by the cathodes 21 and 22 and cause sputtering of the material forming the cathodes. The sputtered particles of the cathode material collect on the surfaces of the cathodes 21 and 22 unexposed to sputtering, the anode 26 and the envelope 12. Noble gasses are pumped by being buried or covered over by the sputtered particles or compounds as they deposit on such surfaces. This results in pumping of the noble gasses such as argon, neon, krypton and xenon.

In one embodiment, the glow discharge provided by the operation of the Penning cell configuration of pump 11 at higher pressures, for example about $10^{-5}$ torr, serves to activate, or reactivate as the case may be, the NEG material anode 26 so as to permit NEG pumping of gases by the anode 26. Such activation can result, for example, by heating the NEG material to 200° C. for 15 minutes. After such high pressure discharge heating of the anode, gases are sorbed by the NEG material forming the outer layer 31*b* of the anode sheets 31. The gap 33 provided between adjacent sheets 31 permits pumping of gases by the opposed outers surfaces 36 and 37 of adjacent sheets in the interior of anode stack 32. In this manner, sputter ion pump 11 additionally serves as a NEG pump for removing non-noble gases such as hydrogen, nitrogen and oxygen from the system being evacuated. The stacked configuration of the sheets 31, and the gap 33 provided between adjacent sheets 31, increases the surface area of the anode 26 available for NEG pumping of gases.

Other configurations of the sputter ion pump with an enhanced anode of the present invention can be provided. In this regard, the anode can have a variety of other configurations, including a conventional square cell egg-crate structure, a conventional array of circular cylinders or a conventional "wavy" strip structure. In another embodiment, the anode can be formed from a block having a plurality of holes in a pattern or array. The block can be formed from the same materials as sheets 31, and for example have an inner portion similar to body 31*a* of the sheets and formed from a conductive metal and an outer portion or layer similar to outer portion or layer 31*b* of the sheets and formed from a suitable material such as an NEG material. The outer portion or layer can extend along the insides of the holes provided in the block.

Figure 5:
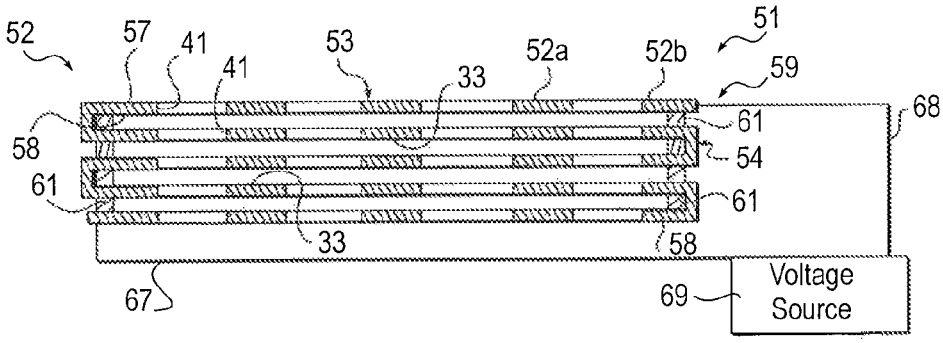
FIG. 5 is a cross-sectional view, similar to FIG. 3, of another embodiment of the anode of the present invention.

In a further configuration of the pump of the present invention, the anode for use with pump 11 can have a single sheet. Anode 51, illustrated in FIG. 5, is substantially similar to anode 26 and like reference numbers have been used to describe like components of anodes 26 and 51. Anode 51 is formed from a single folded sheet or strip 52 having first and second sheet portions 53 and more specifically is shown in FIG. 5 as having a plurality of five sheet portions 53. Adjacent sheet portions 53 are joined at one end by an end or folded portion 54 of the strip 52 and as such the strip 52 has a serpentine configuration when viewed in profile, as seen in FIG. 5. Strip 52 can be substantially similar in composition to sheets 31 and has an inner portion 52*a* similar to body 31*a* of the sheets 31 and formed from a conductive metal and an outer portion 52*b* similar to outer portion or layer 31*b* of the sheets 31 and formed from any suitable material such as an NEG material. The sheet portions 53 can be similar in size and shape to sheets 31, and have opposite first and second planar surfaces 57 and 58 similar to opposite first and second surfaces 36 and 37 of sheets 31. The sheet portions 53 are disposed in juxtaposition to each other to form a stack 59. Gap or space 33 is provided between each set of adjacent sheet portion 53.

At least one spacer 61 is disposed between each of the adjacent spaced-apart sheet portions 53 to form the gap 33 between such adjacent sheet portions. The spacer 61 can be made of any suitable material such as an insulating material so as to not restrict strip 52 from acting as a single electrical body. The spacer 61 can be substantially similar in size, shape and composition to spacer 38, and in one embodiment the at least one spacer 61 can be a single rectangular strip of an insulating material extending between the periphery of the adjacent sheet portions 53. In the embodiment where five sheet portions 53 are provided, four spacers 61 are preferably provided so that a sheet portion 53 forms the top and bottom of the anode 51. The spacers 61 of the anode 51 can be secured to the strip 52 in any suitable manner such as by screws or clamps (not shown).

Each of the sheet portions 53 has a plurality of holes 41 extending between the first surface 57 and the second surface 58, preferably in an identical pattern so that the respective holes 41 in the sheet portions 53 are aligned relative to each other. Each set of aligned holes 41 in the sheet portions 53 forms a through hole or passageway extending through the stack 59 of the anode 51, and thus an anode cell. As discussed above, the holes 41 and related Penning cells can be arranged in any suitable array.

Continuous strip 52 of anode 51 can optionally be coupled at one end to a first electrical lead 67 and at another end to a second electrical lead 68. Leads 67 and 68, shown schematically in FIG. 5, extend through an outside envelope 12 in a conventional manner. The first and second leads can be connected to the high and low poles of a suitable voltage source 69 to provide a potential to the strip 52 of anode 51.

The operation and use of pump 11 having anode 51 is substantially similar to the operation and use of pump 11 having anode 26 discussed above, except that instead of utilizing the glow discharge provided by the operation of the Penning cell configuration of the pump to activate or reactivate the NEG material of anode 51, a potential is provided to the anode strip 52 by means of voltage source 69 and leads 67 and 68 to cause resistive heating of the anode 51, including the NEG layer 52*b* of the anode 51, and thus cause activation or reactivation of the NEG anode 51 so as to permit NEG pumping of gases by the anode 51. Spacers 61 each being formed of an insulating material, instead of a conductive material, facilitate the resistive heating of anode 51. The amount of voltage and current required for activation is dependent in part on the electrical resistance of strip 52 and the power and temperature needed to activate the NEG material of the strip 52. In one embodiment, strip 52 can have an electrical resistance of 0.1 ohm, and a voltage of approximately one volt and a current of approximately ten amps is applied to the strip for a duration of approximately 30 minutes to accomplish activation. After the activation of anode 51, the positive potential is applied to anode 51 in the manner discussed above.

Figure 6:
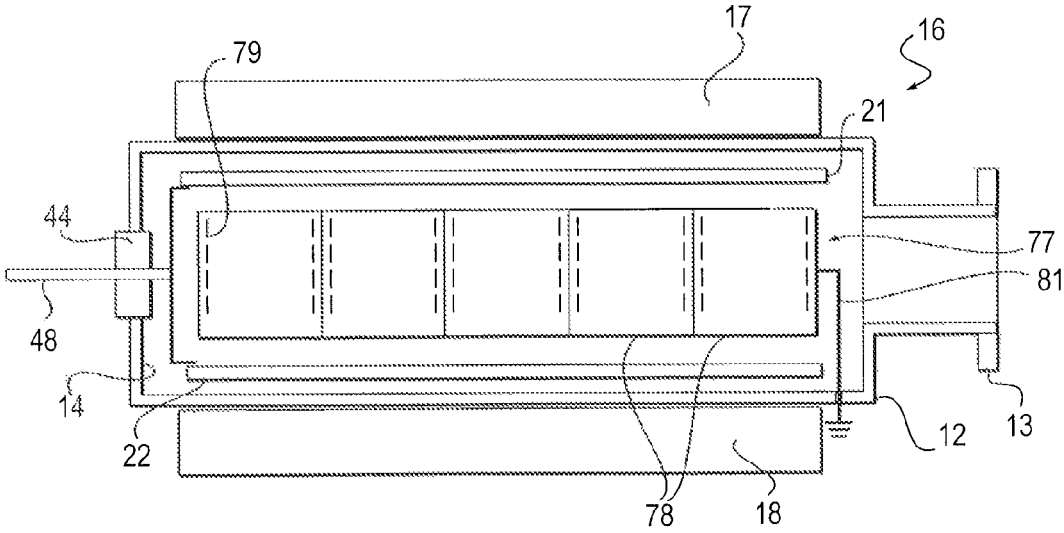
FIG. 6 is a schematic cross-sectional view of a further embodiment of a sputter ion pump with an anode of the present invention.

It is appreciated that the sputter ion pump with NEG anode of the present invention can have a variety of electrical configurations and be within the scope of the present invention. For example, instead of the diode configuration illustrated and discussed above with respect to pump 11, the pump can have a noble diode, galaxy diode or triode configuration. A sputter ion pump 76 with a NEG anode and a triode configuration is illustrated in FIG. 6. The pump 76 is similar to pump 11 and like reference numbers have been used to describe like components of the pumps 11 and 76. Unlike in pump 11, first and second cathodes 21 and 22 of the pump 76 are electrically isolated from the envelope 12. Instead, the cathodes 21 and 22 are electrically coupled to the conductive rod and supported within the envelope by the rod 43, which extends through the envelope 11 and is supported and electrically isolated from the envelope by insulating support 44.

An anode structure or anode of any suitable type is including in the Penning cell pumping element of pump 76 and can include either anode 26 or anode 51 discussed above. Alternatively, a conventional cellular anode assembly or structure 77 can be utilized in pump 77. The anode assembly or anode 77, illustrated in FIG. 6, can include a plurality of circular cylindrical elements 78 joined to one another and disposed between the first and second cathodes 21 and 22. Each cylindrical anode element 78 is hollow and provided with a through hole or passageway 79 that extends along an axis extending perpendicular to the planar cathodes 21 and 22. Each anode element 78 and respective through hole 79 form an anode cell of the sputter ion pump 76. The cross-sectional shape and dimension of holes 79 can be similar to the cross-sectional shape and dimensions of holes 41 described above and, as discussed above the anode cells 78, holes 79 and related Penning cell can be arranged in any suitable array. The anode 77 is supported within the envelope 12 by a rod 81 that extends through the envelope and is electrically coupled to the envelope 12.

Each tubular anode element 78 is formed from a wall 82 that can be substantially similar in composition to sheets 31. In this regard, each wall can have an inner portion (not shown) similar to body 31*a* of the sheets 31 and formed from a conductive metal and an outer portion (not shown) similar to outer portion or layer 31*b* of the sheets 31 and formed from any suitable material such as an NEG material.

The operation and use of pump 76 is substantially similar to the operation and use of pump 11 discussed above. A negative potential of between 3 kv and 7 kv is applied to the first and second cathodes 21 and 22 by means of conductive rod 43, while the anode 77 and envelope 12 are maintained at ground potential. A magnetic field is provided parallel to the axis of each anode element 78 and hole 79 of the anode 77. The high voltage between the anode 77 and the cathodes 21 and 22 produces an electrical breakdown of the gasses within the envelope 12 to form a glow discharge between each set of cathode elements 21 and respective anode element 78. The magnetic field formed by first and second magnets 17 and 18 causes the glow discharge to form a column within each hole 79. Positive ions produced in the glow discharge strike the cathodes 21 and 22. Such ionized molecules are neutralized by the cathodes 21 and 22 and cause sputtering of the material forming the cathodes. The sputtered particles of the cathode material collect on the surfaces of the cathodes 21 and 22 unexposed to sputtering, the anode 77 and the envelope 12. Noble gasses are pumped by being buried or covered over by the sputtered particles or compounds as they deposit on such surfaces. In a manner similar to the operation of pump 11, the glow discharge provided by the operation of the Penning cell configuration of pump 76 serves to activate, or reactivate as the case may be, the NEG material anode 77 so as to permit NEG pumping of gases by the anode 77.

It is appreciated that features of certain embodiments of the sputter ion pump of the present invention can be combined or mixed with features of other embodiments of the invention. For example, the configurations of the cathode and anode structures, as well as the electrical configuration of the pump, can vary and be within the scope of the invention.

It can be seen from the foregoing that a new sputter ion pump with an enhanced anode for increasing pumping speeds has been provided. The inclusion of a NEG material on the outer surface of the anode of the pump permits the pump to act simultaneously as both a sputter ion pump and as a NEG pump, and thus be more efficient and compact than a traditional combination of a distinct sputter ion pump and a distinct NEG pump operated in tandem. The discharge heat produced in the Penning cell configuration of the pump can be utilized to activate the NEG material of the anode. In another aspect of the invention, the anode can be formed for a plurality of strip portions disposed in spaced-apart positions in a stack. The strip configuration of the anode increases the surface area of the anode available for pumping gases. Each of the strips can be of a conventional anode material or can have at least an out layer of NEG material.

What is claimed is:

1. A sputter ion pump comprising an evacuateable envelope having a chamber, first and second cathodes and an anode disposed in the chamber, the anode having at least an outer layer of a non-evaporable getter (NEG) material so as to permit NEG pumping of gases by the anode.

2. A sputter ion pump as in claim 1 wherein the non-evaporable getter material is an alloy of materials, the materials selected from the group consisting of zirconium, vanadium, titanium and palladium.

3. A sputter ion pump as in claim 1 wherein the anode has an inner portion formed from a conductive metal, the outer layer being disposed on the inner portion.

4. A sputter ion pump as in claim 1 wherein the anode is formed with spaced-apart first and second sheet portions disposed in juxtaposition to each other to form a stack, each of the first and second sheet portions having respective first and second surfaces and a plurality of holes extending between the first and second surfaces in an identical pattern so as to form a plurality of passageways extending through the anode in the pattern and a plurality of anode cells.

5. A sputter ion pump as in claim 4 wherein the first and second sheet portions are distinct sheets.

6. A sputter ion pump as in claim 5 further comprising at least one spacer of a conductive material disposed between the first and second sheet portions.

7. A sputter ion pump as in claim 4 wherein the first and second sheet portions are part of a single sheet that includes a fold between the first and second sheet portions.

8. A sputter ion pump as in claim 7 further comprising at least one spacer of an insulating material disposed between the first and second sheet portions.

9. A sputter ion pump as in claim 4 further comprising at least one spacer disposed between the first and second sheet portions.

10. A sputter ion pump as in claim 1 wherein the first and second cathodes are each formed from a getter material selected from the group consisting of titanium, tantalum and zirconium.

11. A sputter ion pump as in claim 1 wherein the anode is disposed between the first and second cathodes.

12. A sputter ion pump as in claim 11 further comprising first and second magnets, the first and second cathodes and the anode being disposed between the first and second magnets.

13. A sputter ion pump as in claim 1 further comprising first and second leads coupled to the anode to permit resistive heating of the anode to activate the non-evaporable getter material of the outer layer.

14. A sputter ion pump comprising an evacuateable envelope having a chamber, first and second cathodes and an anode disposed in the chamber, the anode being formed with spaced-apart first and second sheet portions disposed in juxtaposition to each other to form a stack, each of the first and second sheet portions having respective first and second surfaces and a plurality of holes extending between the first and second surfaces in an identical pattern so as to form a plurality of passageways extending through the anode in the pattern and a plurality of anode cells.

15. putter ion pump as in claim 14 wherein the first and second sheet portions are distinct sheets.

16. A sputter ion pump as in claim 15 further comprising at least one spacer of a conductive material disposed between the first and second sheet portions.

17. A sputter ion pump as in claim 14 wherein the first and second sheet portions are part of a single sheet that includes a fold between the first and second sheet portions.

18. A sputter ion pump as in claim 17 further comprising at least one spacer of an insulating material disposed between the first and second sheet portions.

19. A sputter ion pump as in claim 14 further comprising at least one spacer disposed between the first and second sheet portions.

20. A method for pumping gases in a sputter ion pump having an evacuateable envelope and first and second cathodes and an anode having at least an outer layer of a non-evaporable getter (NEG) material disposed in the envelope, comprising activating the NEG material of the outer layer and sorbing gases on the outer layer.

21. The method of claim 20 wherein the activating step includes applying a potential to the anode to cause resistive heating of the NEG material.

22. The method of claim 20 further comprising the step of ionizing at least some of the gases in the anode to produce a gas discharge and wherein the activating step includes heating the NEG material with the gas discharge.

* * * * *